US009441375B2

(12) United States Patent
Pierce

(10) Patent No.: US 9,441,375 B2
(45) Date of Patent: Sep. 13, 2016

(54) STEEL BAR SEALING APPARATUS AND METHOD

(71) Applicant: Carrick Pierce, Alameda, CA (US)

(72) Inventor: Carrick Pierce, Alameda, CA (US)

( * ) Notice: Subject to any disclaimer, the term of this patent is extended or adjusted under 35 U.S.C. 154(b) by 0 days.

(21) Appl. No.: 14/920,691

(22) Filed: Oct. 22, 2015

(65) Prior Publication Data

US 2016/0138268 A1 May 19, 2016

Related U.S. Application Data

(60) Provisional application No. 62/067,533, filed on Oct. 23, 2014.

(51) Int. Cl.
*E04H 12/00* (2006.01)
*E04C 5/20* (2006.01)
*E04C 5/12* (2006.01)

(52) U.S. Cl.
CPC *E04C 5/20* (2013.01); *E04C 5/125* (2013.01)

(58) Field of Classification Search
CPC ..... E04C 5/20; E04C 5/125
USPC ..... 52/300, 354, 699; 404/59, 60, 66
See application file for complete search history.

(56) References Cited

U.S. PATENT DOCUMENTS 4,302,131 A * 11/1981 Brown ..... E21D 20/025 405/244
4,627,212 A * 12/1986 Yee ..... E04C 5/165 285/294.1
5,732,525 A * 3/1998 Mochizuki ..... E04C 5/165 403/269

OTHER PUBLICATIONS

Declaration of Inventor Carrick Pierce in 2 pages with Exhibit A in 1 page; dated May 11, 2016.

* cited by examiner

*Primary Examiner* — Brian Glessner
*Assistant Examiner* — Joshua Ihezie
(74) *Attorney, Agent, or Firm* — Weide & Miller, Ltd.

(57) ABSTRACT

A bar sealing apparatus includes a hollow, cylindrical intermediate end cap. The end cap has a fitting disposed within an opening. The sealing apparatus further has a hollow, cylindrical terminal end cap and a hollow, cylindrical sleeve that is configured to surround the bar. Internal threads or other fasteners of the fitting may be threaded onto the bar, and internal threads or other fasteners of the intermediate end cap and internal threads or other fasteners of the terminal end cap may be threaded onto external threads or other fasteners of the sleeve. The intermediate end cap, terminal end cap, and sleeve facilitate grout to fill a space between each of the intermediate end cap, terminal end cap, sleeve, and the bar.

20 Claims, 3 Drawing Sheets

STEEL BAR SEALING APPARATUS AND METHOD

CROSS REFERENCE TO RELATED APPLICATION

This application claims priority to U.S. Provisional Application No. 62/067,533 which was filed on Oct. 23, 2014, the contents of which are hereby incorporated by reference.

BACKGROUND

The use of steel to reinforce other structures is well known. For example, steel rods known as rebar (reinforcing bar) are used as a tension device in reinforced concrete and reinforced masonry structures to strengthen and hold the concrete in tension.

Common rebar is made of unfinished tempered steel, making it susceptible to rusting. Normally the concrete cover is able to provide a pH value higher than 12 avoiding the corrosion reaction. However, too little concrete cover can compromise this guard through carbonation from the surface, and salt penetration. Too much concrete cover can cause bigger crack widths which also compromises the local guard.

As rust takes up greater volume than the steel from which it was formed, it causes severe internal pressure on the surrounding concrete, leading to cracking, spalling, and ultimately, structural failure. This phenomenon is known as oxide jacking. This is a particular problem where the concrete is exposed to salt water, as in bridges where salt is applied to roadways in winter, or in marine applications.

Accordingly, uncoated, corrosion-resistant low carbon/chromium (micro-composite), epoxy-coated, galvanized or stainless steel rebars may be employed in these situations. However, these rebars greatly increase costs. Further, extra care must be taken during the transport, fabrication, handling, installation, and concrete placement process when working with epoxy-coated rebar, because damage will reduce the long-term corrosion resistance of these bars. Accordingly, systems and methods for preventing corrosion in steel bars such as rebar without requiring expensive modifications or types of rebars is desired.

SUMMARY

Accordingly a bar sealing apparatus and method for sealing a bar, such as rebar and more specifically a threaded steel bar/rebar, has been developed according to the embodiments disclosed herein. In one exemplary embodiment, there is a bar sealing apparatus comprising a hollow, cylindrical intermediate end cap. Preferably, the intermediate end cap is configured to engage a steel bar and a sleeve which is positioned over the bar. In another embodiment, there is a bar sealing apparatus comprising a terminal end cap. Preferably, the terminal end cap is configured to engage an end of a steel bar and a sleeve which is positioned over the bar. Both types of end caps preferably cooperate with the steel bar and a sleeve to define a sealed or enclosed grout space around the steel bar.

The intermediate end cap comprises a body having an intermediate capped surface at a first end, an opening at a second end, an attachment mechanism disposed on an inner surface of the opening, and a fitting either formed with the body or as a separate element configured to be disposed within the opening. The fitting has a fitting opening toward the second end, and has a bar attachment mechanism within the fitting opening.

The terminal end cap has an end capped surface at a first end, an opening at a second end, and a terminal attachment mechanism configured to engage and end of a steel bar disposed on an inner surface.

The sealing apparatus also comprises a hollow, cylindrical sleeve that is configured to surround a portion of the bar, the sleeve including a fastening mechanism. The bar attachment mechanism of the fitting attaches the fitting onto the bar. The attachment mechanism of the intermediate end cap and the terminal attachment mechanism of the terminal end cap fasten the intermediate and terminal end caps onto the fastening mechanism of the sleeve. In this manner, the intermediate end cap and sleeve and the terminal end cap and sleeve each define a grout space there through and thus a space between each of the intermediate end cap, terminal end cap, the sleeve, and the bar may be filled with corrosive preventing grout.

In some embodiments, the intermediate attachment mechanism and the terminal attachment mechanism comprise internal threads and the fastening mechanism comprises external threads. The intermediate end cap and the terminal end cap may thus be threaded onto the sleeve via the internal and external threads. In other embodiments, the intermediate attachment mechanism and the terminal attachment mechanism comprise a one way clip, the sleeve comprises a corrugated pipe, and the fastening mechanism comprises alternating grooves and ridges. Here, the intermediate end cap and the terminal end cap may be attached to the sleeve via the one way clip and alternating grooves and ridges. An o-ring may also be disposed in one of the grooves of the corrugated pipe between the sleeve and the cylindrical, intermediate end cap to provide an enhanced seal.

The fitting may have an extension opening towards the first end, and the intermediate end cap may have an opening in the intermediate capped surface. This allows a portion of the bar to pass through the extension opening and the opening in the intermediate capped surface. In other embodiments, the intermediate end cap abuts against an end of the bar.

In some embodiments, the intermediate end cap further comprises an intermediate grout opening and an intermediate connection cylinder being disposed on the intermediate grout opening. The intermediate connection cylinder may be configured to allow grout to flow into or out of the intermediate end cap. Similarly the terminal end cap may further comprise a terminal grout opening and a terminal connection cylinder being disposed on the terminal grout opening. The terminal connection cylinder may also be configured to allow grout to flow into or out of the terminal end cap.

The intermediate grout opening and intermediate connection cylinder may be disposed on a cylindrical wall of the intermediate end cap. The terminal grout opening and the terminal connection cylinder may be disposed at the first end of the terminal end cap. The end capped surface on the first end of the terminal end cap may be formed to have a conical shape. The conical shape serves to center the terminal end cap about the bar.

According to other embodiments of the invention, a method for sealing a bar is provided. An intermediate end cap may be used to seal an intermediate section of a steel bar. When the fitting is integral to the body of the intermediate end cap, the fitting is connected to the steel bar with the end cap. The sleeve which is positioned over the steel bar is connected to the end cap, such as by threading it into the internal threads of the cylindrical wall of the intermediate fitting. When the fitting is separate from the body of the intermediate end cap, the fitting is connected to the steel bar and then the body of the end cap is brought into engagement with the fitting and the sleeve.

A terminal end cap may be used to seal an end of a steel bar. The terminal end cap is connected, such as by threading, to a sleeve positioned over a bar, with the end of the bar preferably seated in the terminal end cap. For example, internal threads on the terminal end cap may be engaged with the outer threads of the sleeve.

A grout pipe may be connected via a connection cylinder at a connection aperture of the intermediate or terminal end cap, and the grout pipe may be connected via a connection cylinder at the connection aperture. With the grout pipe connected, grout may be fed into the sleeve, filling the space between the sleeve and the bar, including within the end cap.

In one embodiment, an end of a steel bar may be capped with a terminal end cap and an opposing end of the steel bar may extend through and outwardly of an intermediate end cap, such as for anchoring the bar. In between the terminal and intermediate end cap, a sleeve may extend over the bar. The space between the end caps and the sleeve may be filled with grout, thus encapsulating the bar.

In one embodiment of the invention, the end capped surface on the first end of the terminal end cap is formed to have a conical shape. The conical shape of the end cap serves to center the terminal end cap about the bar. In some embodiments, the intermediate attachment mechanism and the terminal attachment mechanism may comprise internal threads, and the fastening mechanism may comprise external threads. In this embodiment, intermediate end cap and the terminal end cap are thus threaded onto the sleeve via the internal and external threads.

In other embodiments, the intermediate attachment mechanism and the terminal attachment mechanism comprise a one way clip, the sleeve comprises a corrugated pipe, and the fastening mechanism comprises alternating grooves and ridges. The intermediate end cap and the terminal end cap are attached to the sleeve via the one way clip and alternating grooves and ridges. An o-ring that is disposed in one of the grooves of the corrugated pipe between the sleeve and the cylindrical, intermediate end cap may also be provided to enhance the seal around the bar.

In some embodiments, the fitting may have an extension opening towards the first end. The intermediate end cap similarly has an opening in the intermediate capped surface. This allows a portion of the bar to pass through the extension opening and the opening in the intermediate capped surface. In other embodiments, the intermediate end cap abuts against an end of the bar.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

The following embodiments disclose a system, method, and apparatus for coating a steel bar, such as a segment of rebar or a threaded steel bar. In one embodiment, a sheathing is placed over the bar and grout is injected between the sheathing and bar. The sheathing and grout filled between the sheathing and the steel bar provides a seal around the bar and protects the steel bar from corrosion.

Figure 1:
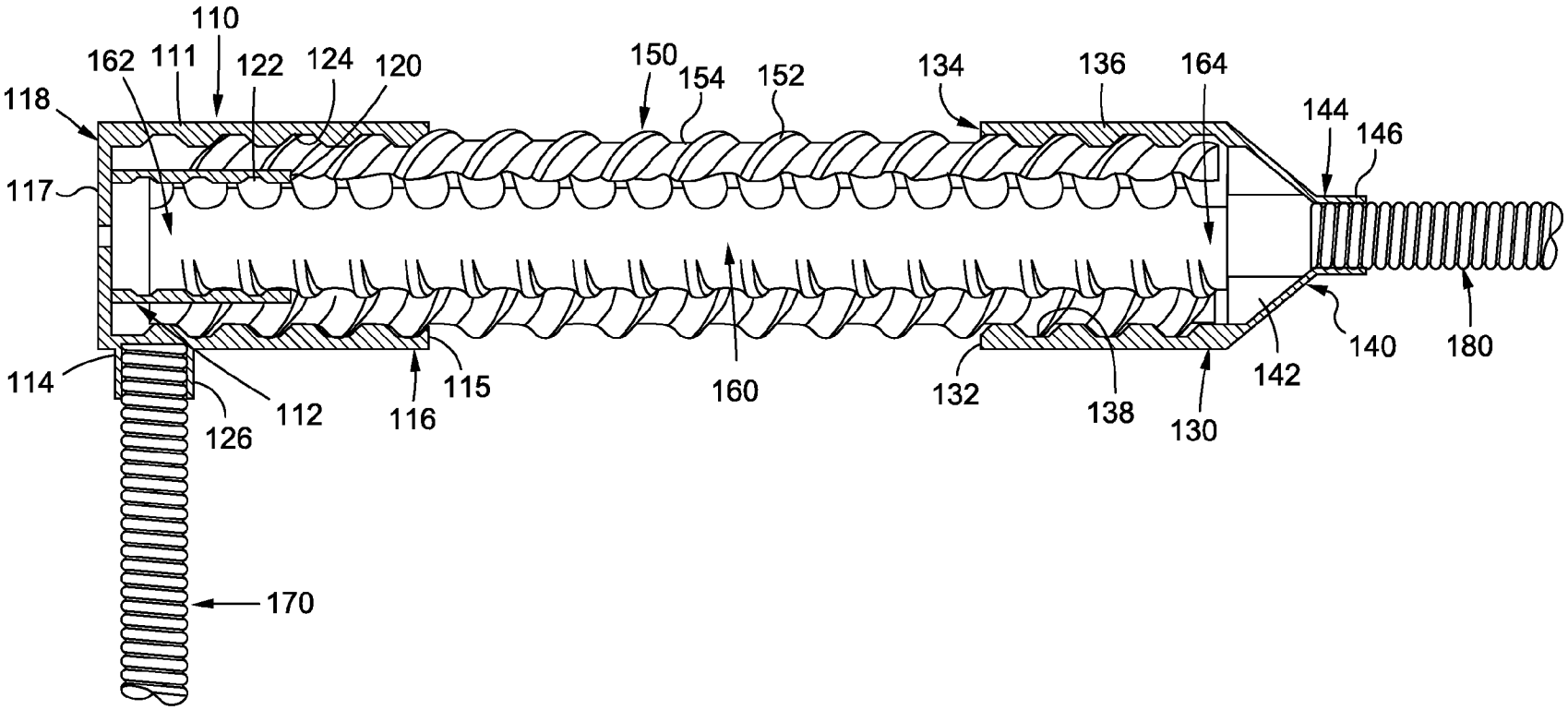
FIG. 1 shows a steel bar sealing apparatus according to one exemplary embodiment.

FIG. 1 shows a system and apparatus for placing a plastic sheathing over a steel bar. The system of FIG. 1 includes an intermediate end cap 110 and a terminal end cap 130 that are configured to surround ends of a steel bar 160. The intermediate end cap 110 and terminal end cap 130 can be formed of any suitable material including corrosion resistant metals such as stainless steel, aluminum, titanium, and precious metals; plastics; or other composite materials. In this embodiment, the end caps 110, 130 are formed from a plastic material made by using a blow molding or injection molding process.

The intermediate end cap 110 is a cylindrically shaped member or body that has an opening 115 on a first end 116 to receive the steel bar 160 therein. In one embodiment, a second end 118 opposing the first end 116 is generally open, permitting the steel bar 160 to pass through the intermediate end cap 110 (whereby the intermediate end cap is positioned "intermediate" the ends of the bar, such as to permit the end of the bar to be positioned outwardly of the intermediate end cap, such as for anchoring, etc., similar to the configuration illustrated in FIG. 3). However, in another embodiment, the end opposing the first end 116 may comprise a capped surface 117 on the second end 118, such as illustrated in FIG. 1. The intermediate end cap 110 further includes a fitting 112 that is configured to be threaded onto or otherwise connect to a section 162 of the steel bar 160. In this embodiment, the fitting 112 incorporates an opening 120 with female threads 122 that thread onto the first end 162 of the steel bar 160 to position the fitting 112 onto the section 162 of the steel bar 160.

The fitting 112 is a cylindrically shaped member that is disposed in the opening 115 of the end cap 110 and is concentric with an outer cylindrical wall 111 of the endcap 110. In one embodiment, the fitting 112 may be formed as part of the end cap 110, whereby when the intermediate end cap 110 is utilized, it simultaneously engages the steel bar 160 and a sleeve, as described below. For example, the fitting 112 may be connected to the outer wall 111 via the capped surface 117 of the end cap 110 and extends concentrically with the outer wall 111 from the capped surface 117. In another embodiment, the fitting 112 may be a separate element form the remainder of the intermediate end cap 110, whereby the fitting 112 may first be connected to the steel bar 160 and the end cap 100 may be both connected to the sleeve and then fitting 112 (e.g. the end cap 110 engages the fitting to define a sealed connection). In either event, the end cap 110 preferably includes or defines a space between the outer wall 111 and the fitting 112.

The intermediate end cap 110 further includes internal threads 124 on an inner surface of the outer cylindrical wall 111. The internal threads 124 are configured to receive a pipe or sleeve 150 that will be described in more detail below. The intermediate end cap 110 also includes a grout aperture 114. The grout aperture 114 is disposed on the outer cylindrical wall 111 of the intermediate end cap 110. The grout aperture 114 may also be disposed in other locations on the intermediate end cap 110. For example, it may be disposed on the capped surface 117, or it may be disposed straddling the capped surface 117 and cylindrical wall 111. The placement of the grout aperture 114 may depend on the size of the annular space between the cylindrical wall 111 and the fitting.

Figure 2:
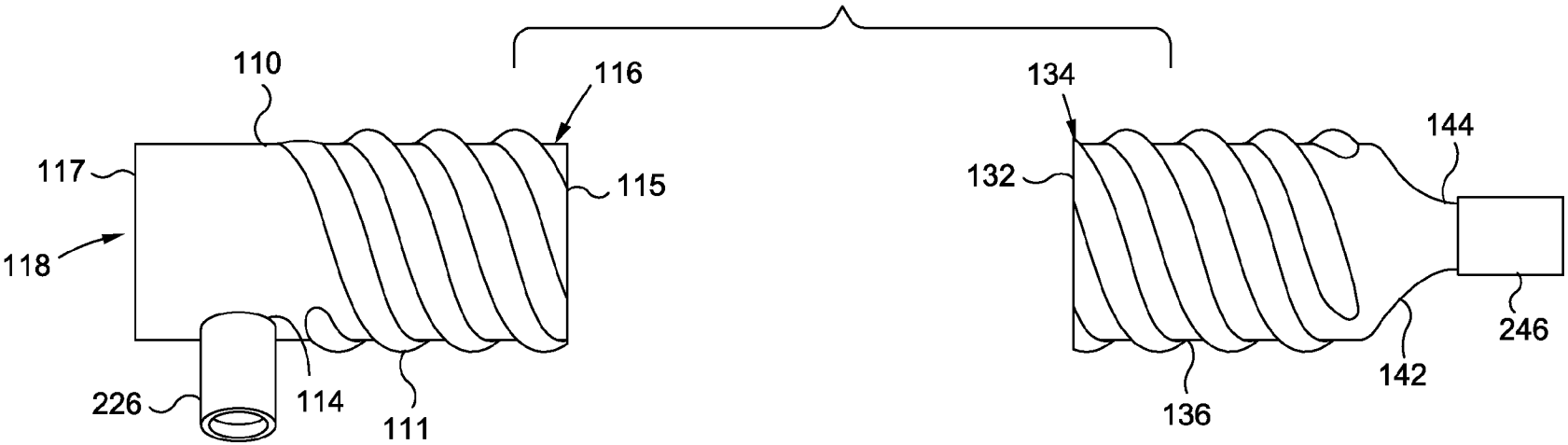
FIG. 2 shows end caps for sealing a steel bar according to one exemplary embodiment.

A connection cylinder, nipple, or other fluid connector 226 may be formed at the grout aperture 114 integrally with or separately from (as shown as connection cylinder 226 in FIG. 2) the end cap 110. In this embodiment, the connection cylinder 126 extends in a direction perpendicular to a longitudinal axis of the cylindrical body of the end cap 110. The connection cylinder 126 is configured to connect with a grout pipe 170 that supplies grout within the sleeve 150, as will be explained below. In some embodiments, when the annular space between the cylindrical wall 111 and the fitting 112 is sufficient, the connection cylinder 114 may extend inward from the cylindrical wall 111.

The terminal end cap 130 is also a cylindrically shaped member that has an opening 132 on a first end 134 to receive the second end 164 of the steel bar 160. An inner surface of cylindrical walls 136 of the opening 132 include internal threads 138 to receive the pipe or sleeve 150. The second end 140 of the terminal end cap 130 includes a capped surface 142 with a grout aperture 144 therein. In this embodiment, the grout aperture 144 is configured in the capped surface 142 so as to be concentric with the opening 132. Further, the capped surface 142 may gradually slope in a conical shape towards the grout aperture 144 as shown in FIG. 1.

A connection cylinder 146 may be formed at the grout aperture 144 integrally with or separately from (as shown as connection cylinder 246 in FIG. 2) the end cap 130. In this embodiment, the connection cylinder 146 extends parallel to and concentric with the cylindrical wall 136 of the terminal end cap 130. The connection cylinder 146 is configured to connect with a grout pipe 180 that supplies grout within the sleeve 150.

The sleeve 150 is a hollow, cylindrical member that is configured to surround the steel bar 160 along the length of the steel bar 160 between its ends 162, 164. The sleeve 150 further includes a plurality of external threads 152 along the outer surface 154 of the sleeve. The external threads 152 are configured to fit within the corresponding internal threads 124, 138 of the intermediate end cap 110 and the terminal end cap 130. The sleeve 150, the intermediate end cap 110, and the terminal end cap 130 constitute a bar sealing apparatus or bar sealing system.

A method of sealing a steel bar 160 such as a reinforcing steel bar (i.e. rebar) using the above apparatus or system will now be described. An intermediate end cap 110 may be used to seal an intermediate section of a steel bar 160. When the fitting 112 is integral to the body of the intermediate end cap 110, the fitting 112 is connected to the steel bar 160 with the end cap 110. The sleeve 150 which is positioned over the steel bar 160 is connected to the end cap 110, such as by threading it into the internal threads 124 of the cylindrical wall 111 of the intermediate fitting 110. When the fitting 112 is separate from the body of the intermediate end cap 110, the fitting 112 is connected to the steel bar 160 and then the body of the end cap 110 is brought into engagement with the fitting 112 and the sleeve 150. The sleeve 150 may be sized so as to cover the entire length of the steel bar 160. Alternatively, the sleeve 150 may be sized to cover a predetermined portion of the steel bar 160 where corrosion protection is desired. That is, a "tail" of the bar 160 may extend beyond or through the sleeve 150 and the associated intermediate end cap 110.

A terminal end cap 130 may be used to seal an end of a steel bar 160. The terminal end cap 130 is threaded onto the other end of the sleeve 150. That is, the internal threads 138 of the terminal end cap 130 are engaged with the outer threads 152 of the sleeve 150. Next, the grout pipe 170 is connected via the connection cylinder 126, 226 at the connection aperture 114, and the grout pipe 180 is connected via the connection cylinder 146, 246 at the connection aperture 122. The grout pipes 170, 180 may be connected to the connection cylinders 126, 226, 146, 246 in any suitable manner including via threads, a quick connect, fasteners, etc. With the grout pipes 170, 180 connected, grout may be fed into the sleeve 150 via either grout pipe 170, 180, and air and grout may be directed out the other grout pipe 170, 180 until the area between the sleeve 150 and the steel bar 160 is filled with grout.

In some embodiments, the capped surface 117 of the intermediate cap 110 may be open to allow grout to flow through so that the steel bar 160 may be anchored to another member. However, with the fitting 112, it is still possible to seal the entire steel bar 160 with grout while maintaining an opening in the capped surface 117 of the intermediate end cap 110.

Further, because the grout can be easily inserted into the sleeve 150 and surround the bar 160, the grout and end caps 110, 130 seal the bar 160 from outside elements, thereby protecting the bar 160 from corrosion due to exposure from potential corrosive elements. The sealed bar 160 and sleeve 150 may then be placed for use, such as by placing it in concrete or grout, or by placing it directly into the ground.

In one embodiment, means are provided for aligning the bar 160 so that it is suspended so that an annular space is defined inside the sheath or sleeve 150 around the bar. This ensures that the grout covers the entire bar. In one embodiment, as illustrated, this means may comprise the fitting 112 of the intermediate end cap 110 and the conical capped surface 142 of the terminal end cap 130. The terminal end cap 130 may also include a seat or similar element for receiving the end 164 of the bar 160 in spaced relationship to the pipe 150.

Figure 3:
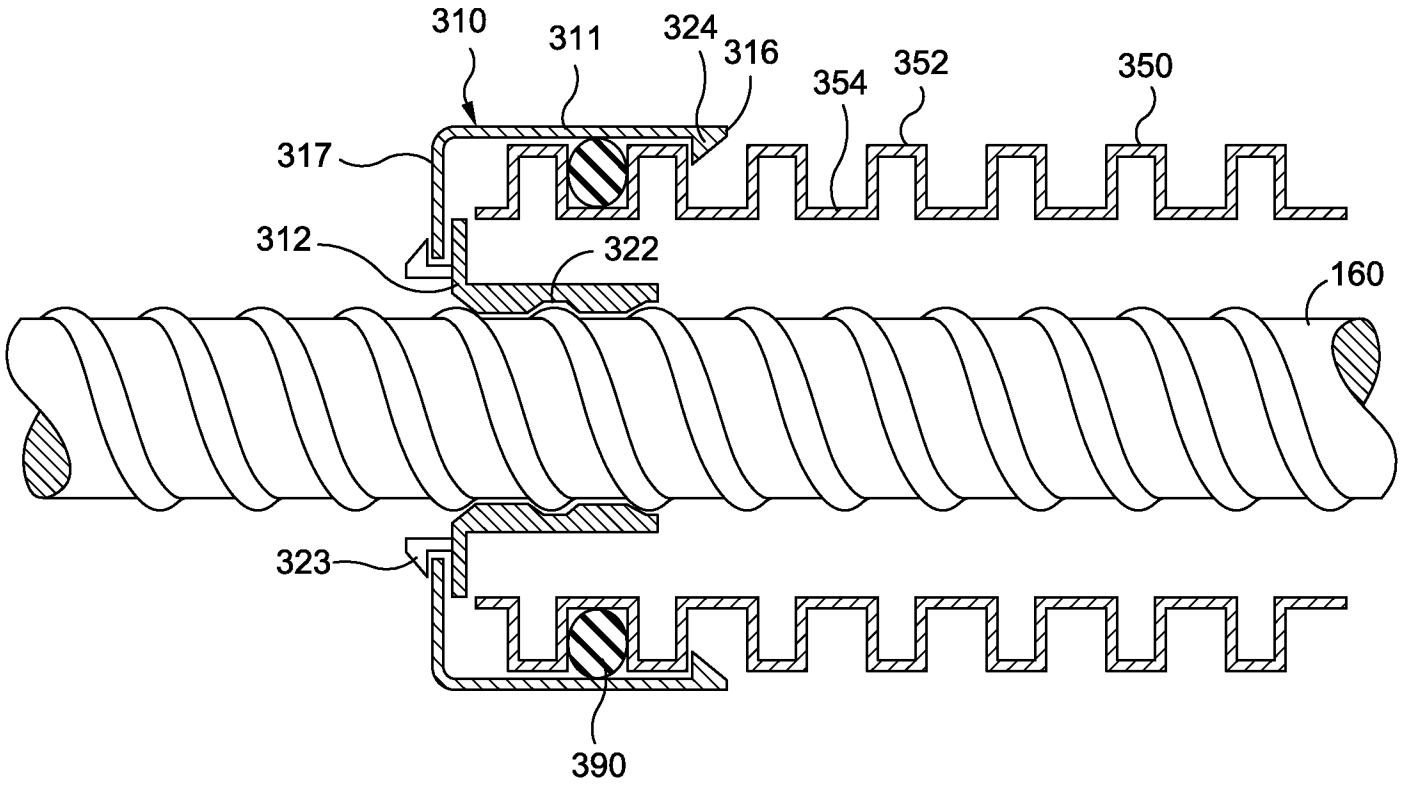
FIG. 3 shows a steel bar sealing apparatus according to another exemplary embodiment.

FIG. 3 shows another embodiment of a steel bar sealing apparatus. Here, another example of an endcap for sealing a steel bar 160 is described. Specifically, an intermediate endcap 310 includes a cylindrical wall 311 and capped surface 317. The intermediate endcap 310 further includes an opening 316 to receive the steel bar 160 and sleeve 350. A fitting 312 is also included in the intermediate endcap 310. In this embodiment, the fitting 312 is shown to allow the steel bar 160 to extend therethrough. Thus, in this embodiment, the steel bar sealing apparatus is configured to seal a portion of the steel bar. However, the intermediate endcap 310 could also be configured to be disposed at an end of the steel bar 160.

The fitting 312 includes internal threads 322 to be fitted onto the desired position of the steel bar 160. Alternately, the internal threads 322 may be depressed to fit over corresponding projections from the steel bar 160. The fitting 312 includes an attachment clip 323 that fits onto the capped surface 317 of the intermediate end cap 310.

In this embodiment, the sleeve 350 is a corrugated pipe with alternating ridges 352 and grooves 354. The intermediate endcap 310 may thus be fitted and retained onto the sleeve 350 by a one-way clip 316, such as a barbed clip, that snaps into the grooves 354 of the sleeve. To maintain a better seal, the sleeve may include an o-ring 390 (or other sealing member) within one of the grooves 354. The o-ring 390 creates a seal between the cylindrical wall 311 of the endcap 310 and the sleeve 350. Of course, while not shown, a terminal end cap may connect to the sleeve 350 in a similar manner as the intermediate end cap 310.

It will be appreciated that the invention may be applied to different types of bars, including bars made of steel and other metals. The invention may be applied to bars of various lengths. Further, as indicated herein, the configuration of the sleeve and its connection to an end cap (terminal or intermediate) may vary. As indicated, various means may be provided for mechanically connecting an end cap to the sleeve. Such means may comprise threads, clips or other members. For example, a sleeve might have a generally smooth outer surface but have a circumferential groove near each end which is configured to receive one or more tabs or clips of an end cap. In another embodiment, the sleeve might have an outwardly extending circumferential rib near an end thereof and the end cap may have an internal groove, whereby the end cap is press fit until the rib fits into the groove, thus connecting the two elements in a sealed fashion.

Likewise, various means may be utilized to connect an end cap to a steel bar. For example, the fitting 110 of an intermediate end cap 110 might include threads for threading connection to a steel bar 160. However, other mechanical connections might be used, such as clips, ribs, keys and slots, etc.

As indicated, in one embodiment, the fitting 110 and the intermediate end cap body might be formed as separate elements to allow separate connection of the fitting 110 to the steel bar 160 and then connection of the body of the intermediate end cap to the sleeve and to the fitting 110. A seal may be provided for ensuring sealing between the fitting 110 and the body of the end cap in this situation.

Various types of grout may be used to coat the bar. Preferably, the grout is liquid or has a viscosity such that the grout is flowable, whereby it may be injected into the sheath. The grout may harden into a solid or semi-solid state. The grout is preferably water-resistant so that it protects the bar from corrosion.

It will be appreciated that various combinations of sleeves and terminal and/or intermediate end caps may be utilized in association with a steel bar. For example, in one embodiment a sleeve may extend over the entire length of a steel bar and the ends thereof may be capped or sealed with terminal end caps. In another embodiment, several intermediate end caps may be located along a length of steel bar and be connected to sections of sleeving. In another embodiment, a first end of a steel bar may be sealed with a terminal end cap and the second end of the steel bar may extending through and outwardly of an intermediate end cap, such as to an anchor point, with the portion of the steel bar between the terminal and intermediate end caps located within a sleeve.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A bar sealing apparatus comprising:

a hollow, cylindrical intermediate end cap comprising a cylindrical body having an at least partially capped surface at a first end and an opening at a second end, an attachment mechanism disposed on an inner surface of the opening, and a fitting disposed within the opening, the fitting being connected to the cylindrical body at the intermediate capped surface, the fitting having a fitting opening toward the second end, and the fitting having a bar attachment mechanism within the fitting opening;

a hollow, cylindrical sleeve that is configured to surround the bar, the sleeve including a fastening mechanism, the bar attachment mechanism mechanically attaching the fitting onto the bar, the attachment mechanism mechanically fastening the intermediate end cap onto the fastening mechanism of the sleeve, and the intermediate end cap and sleeve being configured to facilitate grout there through thereby filling a space between the bar and each of the intermediate end cap and the sleeve.

2. The bar sealing apparatus of claim 1, wherein the attachment mechanism of the intermediate end cap comprises internal threads, the fastening mechanism of the sleeve comprises external threads, and the intermediate end cap is threaded onto the sleeve via the internal and the external threads.

3. The bar sealing apparatus of claim 1 wherein the attachment mechanism of the intermediate end cap comprises a one way clip, the sleeve comprises a corrugated pipe, the fastening mechanism of the sleeve comprises alternating grooves and ridges, and the intermediate end cap is mechanically attached to the sleeve via the one way clip and alternating grooves and ridges.

4. The bar sealing apparatus of claim 3, further comprising an o-ring that is disposed in one of the grooves of the corrugated pipe between the sleeve and the cylindrical body of the intermediate end cap.

5. The bar sealing apparatus of claim 1, wherein the fitting has an extension opening towards the first end, the capped surface of the cylindrical body extends from the connection to the fitting to an outer wall of the cylindrical body, and a portion of the bar is configured to pass through the extension opening.

6. The bar sealing apparatus of claim 1, wherein the fitting comprises a capped surface towards to the first end, and the intermediate end cap abuts against an end of the bar.

7. The bar sealing apparatus of claim 1, wherein the intermediate end cap further comprises a grout opening and an intermediate connection cylinder that is disposed on the grout opening, the connection cylinder being configured to allow grout to flow into or out of the intermediate end cap.

8. The bar sealing apparatus of claim 7, wherein the grout opening and connection cylinder are disposed on the cylindrical wall of the intermediate end cap.

9. The bar sealing apparatus of claim 1, wherein the bar attachment mechanism of the fitting comprises internal grooves that correspond to and mechanically fasten to ribs of the bar.

10. The bar sealing apparatus of claim 1, further comprising a terminal end cap comprising a cylindrical body having an end capped surface at a first end, an opening at a second end, and a terminal attachment mechanism disposed on an inner surface of the cylindrical body of the terminal end cap, the terminal attachment mechanism mechanically attaching the terminal end cap to the sleeve.

11. The bar sealing apparatus of claim 10, wherein the end capped surface on the first end of the terminal end cap is formed to have a conical shape extending from the cylindrical body of the terminal end cap, the conical shape centering the terminal end cap about the bar.

12. The bar sealing apparatus of claim 11, wherein the terminal end cap further comprises a grout opening and a connection cylinder disposed on the grout opening, the connection cylinder being configured to allow grout to flow into or out of the terminal end cap.

13. The bar sealing apparatus of 12, wherein the grout opening and the connection cylinder are disposed on the conical shape of the terminal end cap.

14. A bar sealing apparatus comprising:

a hollow, cylindrical terminal end cap comprising a cylindrical body having an at least partially capped surface at a first end and an opening at a second end, a bar alignment portion configured to center the terminal end cap on an end of the bar, and an attachment mechanism disposed on an inner surface of the opening; and a hollow, cylindrical sleeve that is configured to surround the bar, the sleeve including a fastening mechanism, the attachment mechanism mechanically fastening the terminal end cap onto the fastening mechanism of the sleeve, and the terminal end cap and sleeve being configured to facilitate grout there through thereby filling a space between the bar and each of the terminal end cap and the sleeve.

15. The bar sealing apparatus of claim 14, wherein the capped surface on the first end of the terminal end cap is formed to have a conical shape extending from the cylindrical body of the terminal end cap, the conical shape defining the bar alignment portion to center the terminal end cap on the end of the bar.

16. The bar sealing apparatus of claim 15, wherein the terminal end cap further comprises a grout opening and a connection cylinder disposed on the grout opening, the connection cylinder being configured to allow grout to flow into or out of the terminal end cap.

17. The bar sealing apparatus of 12, wherein the grout opening and the connection cylinder are disposed on the conical shape of the terminal end cap.

18. A method for sealing a bar, the method comprising:

providing a hollow, cylindrical intermediate end cap comprising a cylindrical body having an at least partially capped surface at a first end and an opening at a second end, an attachment mechanism disposed on an inner surface of the opening, and a fitting disposed within the opening, the fitting being connected to the cylindrical body at the intermediate capped surface, the fitting having a fitting opening toward the second end, and the fitting having a bar attachment mechanism within the fitting opening connecting the bar to the fitting of the intermediate end cap via the fitting attachment mechanism;

mechanically attaching the intermediate end cap to a first end of a hollow, cylindrical sleeve that is configured to surround the bar, the sleeve including a fastening mechanism to attach with the attachment mechanism of the intermediate end cap;

mechanically attaching the bar attachment mechanism of the fitting to the bar; and injecting grout into one of the intermediate end cap thereby filling a space between the bar and each of the intermediate end cap and sleeve and surrounding the bar.

19. The method of claim 18, wherein the intermediate end cap further comprises a grout opening and an connection cylinder being disposed on the grout opening, and the grout is injected into or out from the connection cylinder to fill the space.

20. The method according to claim 18, wherein the fitting has an extension opening towards the first end, the capped surface of the cylindrical body extends from the connection to the fitting to an outer wall of the cylindrical body, and a portion of the bar is configured to pass through the extension opening.

* * * * *